United States Patent [19]

Wood

[11] Patent Number: 4,763,100

[45] Date of Patent: Aug. 9, 1988

[54] JOYSTICK WITH ADDITIONAL DEGREE OF CONTROL

[76] Inventor: Lawson A. Wood, 905 N. Frederick St., Arlington, Va. 22205

[21] Appl. No.: 84,937

[22] Filed: Aug. 13, 1987

[51] Int. Cl.[4] ..... H01C 10/16

[52] U.S. Cl. ..... 338/128; 74/471 XY

[58] Field of Search ..... 338/128; 74/471 XY

[56] References Cited

U.S. PATENT DOCUMENTS

| | | | |
|---|---|---|---|
| 3,784,746 | 1/1974 | Hess | 338/128 X |
| 3,931,606 | 1/1976 | Oka et al. | 338/128 |
| 3,940,674 | 2/1976 | Gill | 74/471 XY X |
| 4,127,841 | 11/1978 | Kato et al. | 338/128 |
| 4,156,130 | 5/1979 | Ivashin et al. | 338/128 X |
| 4,281,561 | 8/1981 | Groskopfs | 338/128 X |
| 4,533,899 | 8/1985 | Isaksson | 338/128 |
| 4,555,960 | 12/1985 | King | 74/471 XY |
| 4,641,123 | 2/1987 | Whitehead | 338/128 |

*Primary Examiner*—C. L. Albritton

*Attorney, Agent, or Firm*—Spencer & Frank

[57] ABSTRACT

A joystick includes a pivotably mounted X yoke connected to an X potentiometer and a pivotably mounted Y yoke connected to a Y potentiometer. To permit at least one additional degree of control, a platform member is pivotably mounted one of the yokes to support an additional control element such as a further potentiometer. The pivoting motion of the platform member with respect to the yoke element on which it is mounted is conveyed to the remaining yoke element. Both a platform member and the remaining yoke element pivot about respective axes that are perpendicular to the pivot axis of the yoke element on which the platform member is mounted.

20 Claims, 3 Drawing Sheets

JOYSTICK WITH ADDITIONAL DEGREE OF CONTROL

BACKGROUND OF THE INVENTION

The present invention is directed to a joystick having at least one degree of control in addition to the traditional X control and Y control. More particularly, the present invention is directed to a joystick having a shaft which can be manually moved in the X and Y directions to control X and Y potentiometers, and which can also be manually rotated and/or moved along its axis to actuate at least one further control element such as a potentiometer or switch.

A joystick is an electromechanical control device having a shaft which an operator can pivot in various directions. Perhaps the best-known application for joysticks is to control electronic games, but other uses such as cursor control on computer displays or steering control of vehicles are also known. In a typical conventional joystick two yoke elements are mounted at right angles to each other so that they are individually pivotable. Each yoke element is coupled to a respective potentiometer. Furthermore each yoke element has an elongated slot through which the shaft extends, so that manual movement of the shaft in any direction is coupled, depending upon the direction and magnitude of the shaft's movement, to the potentiometers by way of the yokes. A conventional joystick such as this provides X-Y control.

In view of the general usefulness of X-Y control as provided by the conventional joystick described above, it is not surprising that attempts have been made to design joysticks with one or more further degrees of control, such as Z-axis control or rotational control. For example, U.S. Pat. No. 4,156,130 discloses a joystick with a first potentiometer which is mounted on a chassis, a second potentiometer which is mounted on the shaft of the first potentiometer and which is disposed at right angles to the first potentiometer, a third potentiometer which is mounted on the shaft of the second potentiometer and which is disposed at right angles to both the first and second potentiometers, and a linear-motion-type potentiometer which connects the control lever of the joystick to the shaft of the third potentiometer. As a result of this construction the joystick of U.S. Pat. No. 4,156,130 permits both Z-axis control and rotational control, about the Z axis, in addition to the conventional X-Y control.

However joysticks with more than X-Y control tend to be either flimsy or mechanically complicated, which leads to increased expense. Accordingly, it would be desirable to provide an improved joystick which is both sufficiently rugged and sufficiently inexpensive to permit at least one additional degree of control in practical situations.

SUMMARY OF THE INVENTION

An object of the present invention is to provide a rugged and relatively inexpensive joystick which permits at least one degree of control in addition to X-Y control.

Another object of the present invention is to provide a joystick having a platform member which is pivotably mounted on one of the yoke elements, with an additional control element such as a potentiometer or switch or both being mounted on the platform.

These and other objects which will become apparent in the ensuing detailed description can be attained by providing a joy stick which includes first and second potentiometers mounted on a chassis, a first yoke element which is mounted on the chassis for pivoting movement about a first axis and which is coupled to the first potentiometer, a second yoke element which is mounted on the chassis for pivoting movement about a second axis and which is coupled to the second potentiometer, the second axis being orthogonal to the first axis, a platform which is mounted on the first yoke element for pivoting movement about a third axis which is orthogonal to the first axis, and coupling means for pivoting the second yoke element about the second axis when the platform pivots about the third axis, the coupling means being operatively connected to the platform and extending through a slot in the second element.

DESCRIPTION OF THE PREFERRED EMBODIMENTS

Figure 1:
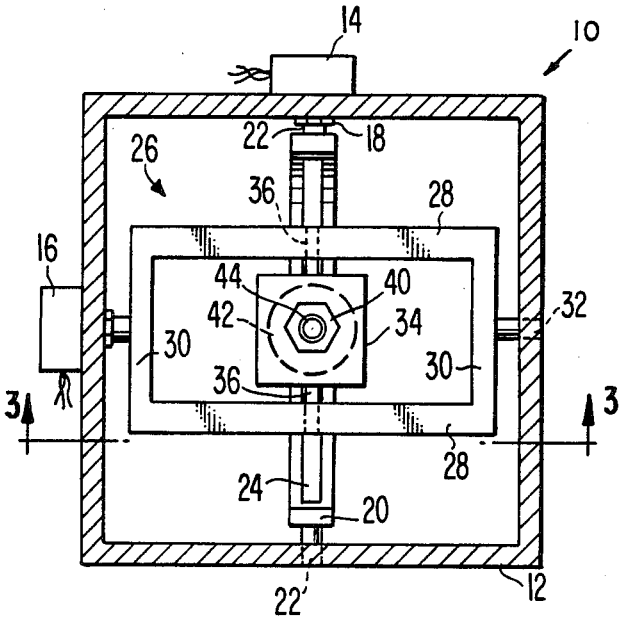
FIG. 1 is a top view, partially in section, illustrating a joystick in accordance with a first embodiment of the present invention.

In FIG. 1, a joystick 10 includes a chassis 12 on which X potentiometer 14 and Y potentiometer 16 are mounted by nuts 18 in the conventional manner. An X yoke element 20 terminates in mounting posts 22 and has a central arcuate portion (see FIG. 2) with a slot 24. One post 22 is pivotably disposed in a hole in chassis 12 and the other post 22 is connected to the shaft of potentiometer 14. Although not illustrated, such connection can be provided, for example, by a sleeve which joins the shaft of potentiometer 14 to the mounting post 22.

With continuing reference to FIG. 1, joystick 10 also includes a Y yoke element 26 having side portions 28, end portions 30, and mounting posts 32 which extend outward from end portions 30. One post 32 is pivotably disposed in a hole in chassis 12, and the other post 32 is connected to the shaft of potentiometer 16. A platform member 34 is provided with mounting posts 36 which extend through holes in side portions 28 to pivotably mount platform member 34 between portions 28. A nut 40 mounts an additional control element such as potentiometer 42 to platform member 34, with the shaft 44 of potentiometer 42 extending upward to serve as the control lever for joystick 10. Although the additional control element in this embodiment is a potentiometer, other manually operable electrical controls such as, for example, a multi-position rotary switch, a momentary contact push-button switch, a press-on/press-off push-button switch, etc., could be used instead.

Figure 3:
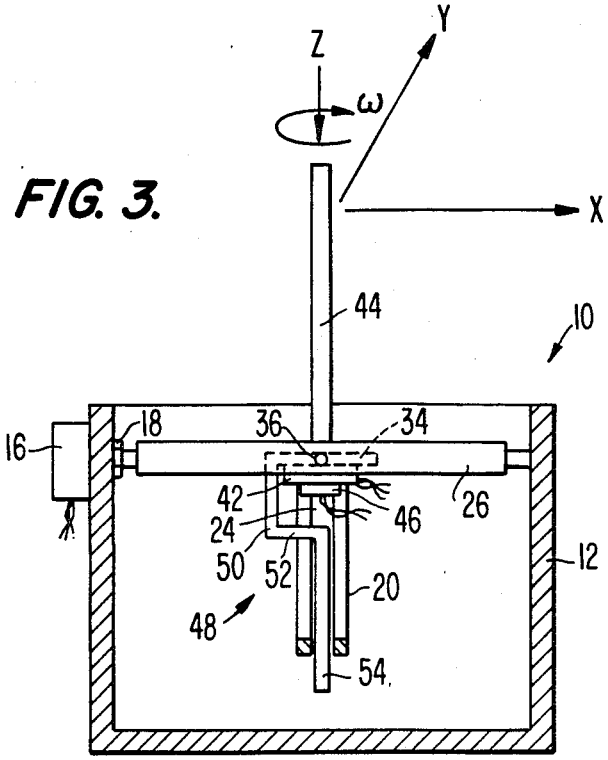
FIG. 3 is a sectional view taken along the line 3—3 in FIG. 1.

Turning next to FIG. 3, potentiometer 42 has a switch portion 46 which is also operated by shaft 44.

That is, the resistance of potentiometer 42 is changed by rotating shaft 44 about its axis, in the ω direction, and switch portion 46 is closed by pressing shaft 44 downward in the Z direction.

Platform member 3 includes and is integrally connected with a descending leg portion 48. Leg portion 48 has a first vertical segment 50, a horizontal segment 52, and a second vertical segment which slidably extends through slot 24 in yoke element 20.

The operation of joystick 10 will now be described. When shaft 44 is moved along the X-axis, from the vertical position shown, it will be apparent that platform member 34 pivots and that vertical segment 54 also causes X yoke element 20 to pivot. As a result the resistance of X potentiometer 14 is changed. On the other hand when shaft 44 is moved along the Y-axis, from the vertical position shown, platform member 34 does not pivot with respect to Y yoke element 26. Instead, platform member 34 and yoke element 26 rotate together, so that the resistance of Y potentiometer 16 is changed. As this occurs vertical segment 54 simply moves along slot 24 without displacing X yoke element 20. It will be apparent that if shaft 44 is moved in a direction having both an X component and a Y component, both X yoke element 20 and Y yoke element 26 would be deflected in an amount depending upon the respective component. Finally, at any angular position of shaft 44, shaft 44 can be rotated or moved linearly along its axis without thereby changing the position of either X yoke element 20 or Y yoke element 26. However rotation of shaft 44 changes the resistance of potentiometer 42, thus providing one additional degree of control, and moving shaft 44 along its axis actuates switch portion 46 to provide yet another degree of control.

Figure 4:
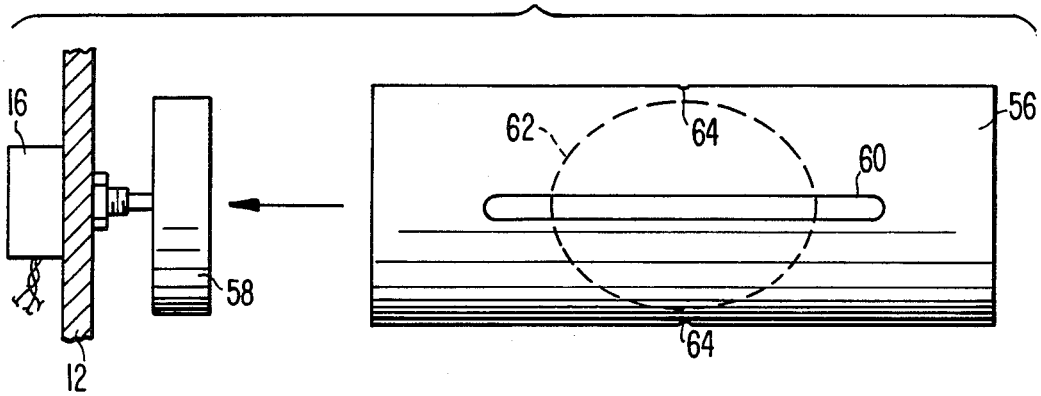
FIG. 4 is an exploded top view illustrating a yoke sleeve, potentiometer, and coupling member employed in a second embodiment of the present invention.
Figure 5:
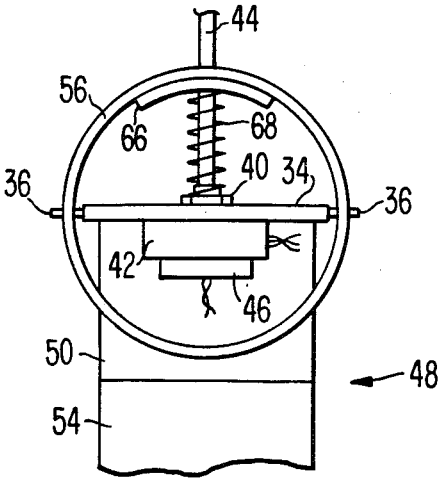
FIG. 5 is an end view illustrating the yoke sleeve of FIG. 4 with the platform.

The second embodiment of the present invention is the same as joystick 10 except that a Y yoke element 26 is not used. Instead, a yoke sleeve 56 is employed as shown in FIGS. 4 and 5.

Yoke sleeve 56 is open-ended. To mount sleeve 56, one end is forced-fit around a rubber support wheel 58 that is attached to the shaft of Y potentiometer 16, and the other end is dropped into a recess (not illustrated) on the opposite side of chassis 12. As a result sleeve 56 is rotatably mounted and the angular position thereof is communicated to potentiometer 16 by frictional engagement between wheel 58 and the inner surface of sleeve 56. The top surface of sleeve 56 is provided with a slot 60 which extends along the X-axis, and the underside is provided with an opening 62 so that platform member 34 can be mounted within sleeve 56 during assembly. A mounting hole 64 is provided on either side of sleeve 56 to pivotably receive the mounting posts 36 of platform member 34. During assembly one post 36 is inserted into the respective hole 64, and force is exerted on sleeve 56 to slightly flatten it, momentarily, so that the other post 36 can be inserted.

After assembly leg portion 48 (see FIG. 3) of platform member 34 extends downward through opening 62 and shaft 44 extends upward through slot 60. As is shown in FIG. 5, a cover member 66, having a configuration which conforms to the curvature of sleeve 56, is disposed inside sleeve 56 and is biased upwardly by spring 68. Shaft 44 extends through a hole (not illustrated) in cover member 66. Cover member 66 slides with respect to sleeve 56 when shaft 44 is moved along slot 60, and serves the aesthetic function of shielding the inside of yoke 56 from view.

Figure 6:
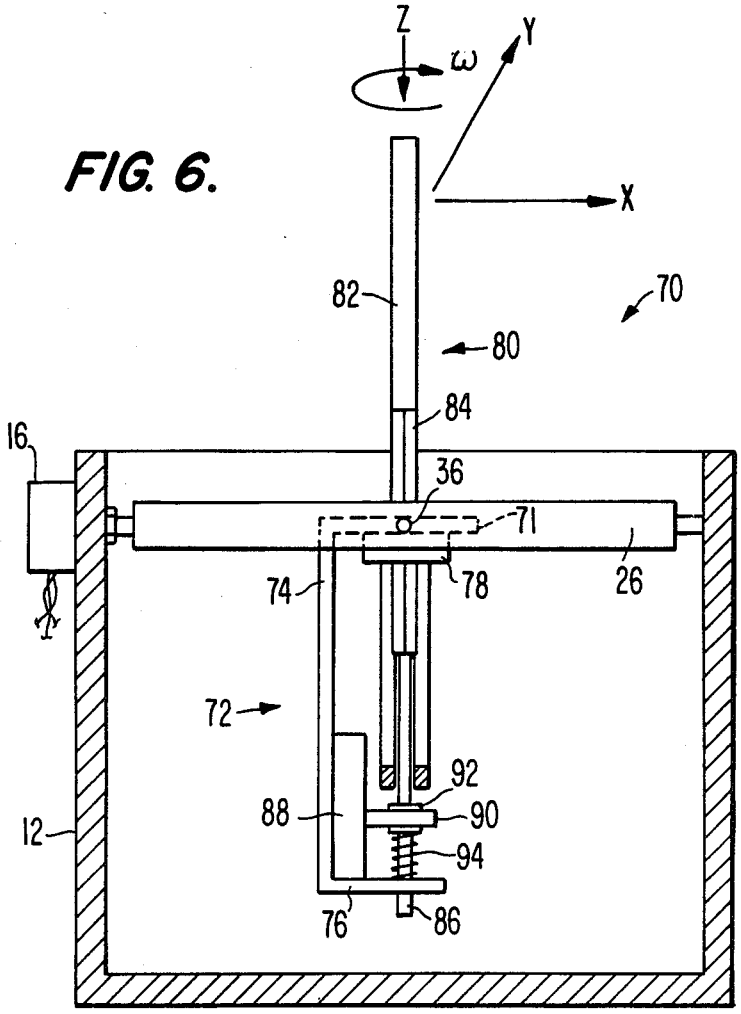
FIG. 6 a side view, partially in section, illustrating a third embodiment of the invention.

The joystick 70 shown in FIG. 6 employs a platform member 71 having an integrally connected leg portion 72 with a configuration that is different from that of the leg portion 48 shown in FIG. 3. Leg portion 72 includes a vertical segment 74 and a horizontal segment 76. A potentiometer 78 is attached to platform member 71 as an additional control element. In lieu of a shaft that is integral with the potentiometer, potentiometer 78 has a square opening (not illustrated). Shaft 80 has a first cylindrical portion 82, a square portion 84 which slidably extends through the square opening in potentiometer 78, and a second cylindrical portion 86 of reduced diameter which slidably extends through a hole (not illustrated) in horizontal portion 76. It will be apparent that shaft 80 is keyed to potentiometer 78, so that the resistance of potentiometer 78 can be controlled by rotating shaft 80 about its axis and so that shaft 80 can be moved linearly along its axis without changing the resistance of potentiometer 78. A linear-movement type potentiometer 88 having a tap slide 90 is adhesively attached to leg portion 72 of platform member 71. Collars 92 are fixedly attached to portion 86 at spaced-apart positions and tap slide 90 extends between collars 92, thereby coupling tap slide 90 to shaft 80 with respect to linear movement of shaft 80 but permitting shaft 80 to rotate with respect to shaft 80. A spring 94 extends between portion 76 and the lowermost collar 92 to bias shaft 80 upward.

Figure 2:
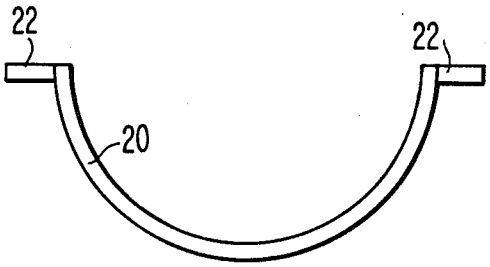
FIG. 2 is a side view illustrating one of the yoke elements shown in FIG. 1.

While joystick 10 in the embodiment of FIGS. 1–3 provided an additional control element in the form of a potentiometer having a switch, joystick 70 includes a potentiometer 78 which is responsive to rotation of shaft 80 and a potentiometer 88 which is responsive to linear motion of shaft 80. Thus in addition to the traditional X-Y control, joystick 70 provides two independent and continuously variable degrees of control.

Figure 7:
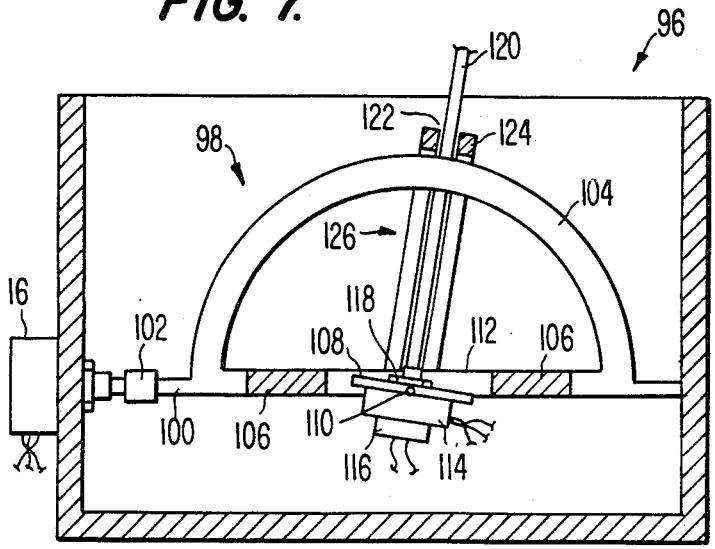
FIG. 7 is a side view, partially in section, illustrating a fourth embodiment of the invention.

Referring next to FIG. 7, joystick 96 includes a Y yoke element 98 having one mounting peg 100 which is pivotably disposed in an opening (not illustrated) in housing 12 and another mounting peg 100 which is joined by a sleeve 102 to the shaft of Y potentiometer 16. Yoke element 98 also includes an arcutate portion 104 having an elongated slot (not illustrated) in it, and a base portion 106. Platform 108 has a pair of mounting posts 110 (only one of which is shown) by which platform 108 is pivotably mounted to yoke element 98 in an opening 112 in base portion 106. Potentiometer 114, having a switch portion 116, is mounted on platform member 108 by nut 118. The shaft 120 of potentiometer 114 extends through the slot (not illustrated) in arcuate portion 104 and through the slot 122 in the arcuate portion 124 of an X yoke element 126 which is also pivotably mounted in housing 12. It will be apparent that shaft 120 can be moved in the X direction to pivot X yoke element 126, in the Y direction to pivot Y yoke element 98, or in a direction having both X and Y components to pivot both yoke elements 98 and 126. Additionally shaft 120 can be rotated about its axis to control The resistance of potentiometer 114 and can be moved along its axis to actuate switch portion 116.

What I claim is:

1. A joystick, comprising:

a chassis;

a first potentiometer mounted on the chassis;

a first yoke element mounted on the chassis for pivoting movement about a first axis;

first means for coupling the first potentiometer to the first yoke element;

a second potentiometer mounted on the chassis;

a second yoke element mounted on the chassis for pivoting movement about a second axis that is orthogonal to the first axis;

second means for coupling the second potentiometer to the second yoke element;

a platform member;

means for mounting the platform member on the first yoke element so that the platform member is pivotable about a third axis that is orthogonal to the first axis;

manually operable means for moving the platform member; and coupling means, extending from the platform member and slidably engaging the second yoke element, for pivoting the second yoke element about the second axis when the platform member pivots about the third axis.

2. The joystick of claim 1, wherein the first yoke element has two ends, one end being journaled to the chassis and the other end being connected to first means.

3. The joystick of claim 2, wherein the first yoke element additionally has side portions disposed between the two ends, the platform member being disposed between the side portions and the means for mounting the platform member engaging both side portions.

4. The joystick of claim 3, wherein the second yoke element has a slot, and further comprising an electrical control element mounted on the platform member, the electrical control element having a shaft which serves as the manually operable means and which extends through the slot in the second yoke element to additionally provide the coupling means.

5. The joystick of claim 4, wherein the electrical control element comprises another potentiometer having a resistance which changes when the shaft is manually rotated.

6. The joystick of claim 5, wherein the electrical control element further comprises a switch mounted on the another potentiometer, the switch being controlled by manual movement of the shaft along its axis.

7. The joystick of claim 4, wherein the shaft slidably extends through the control element and is keyed to the control element, wherein the platform member has a leg portion, and further comprising another potentiometer mounted on the leg portion, and means coupling the shaft to the another potentiometer for controlling the another potentiometer when the shaft is manually moved along its axis.

8. The joystick of claim 3, further comprising an electrical control element mounted on the platform member, the electrical control element having a manually actuable shaft which serves as the manually actuable means, and wherein the platform member has a leg portion which slidably engages the second yoke element to provide the coupling means.

9. The joystick of claim 8, wherein the electrical control element comprises another potentiometer having a resistance which changes when the shaft is manually rotated.

10. The joystick of claim 9, wherein the electrical control element further comprises a switch mounted on the another potentiometer, the switch being controlled by manual movement of the shaft along its axis.

11. The joystick of claim 9, wherein the first yoke element comprises a tubular sleeve and wherein the first means comprises a disc affixed to the shaft of the first potentiometer, one end of the sleeve being connected to the disc.

12. The joystick of claim 11, wherein the sleeve has a top portion with a slot through which the shaft extends and a bottom portion with an aperture through which the leg portion extends, and wherein the means for mounting the platform member pivotably mounts a portion of the platform member inside the sleeve.

13. The joystick of claim 12, further comprising a cover member slidably disposed inside the sleeve, the shaft extending through the cover member, and means for biassing the cover member away from the platform member.

14. The joystick of claim 1, wherein the second yoke element has a slot, and further comprising an electrical control element mounted on the platform member, the electrical control element having a shaft which serves as the manually operable means and which extends through the slot in the second yoke element to provide the coupling means.

15. The joystick of claim 14, wherein the shaft slidably extends through the control element and is keyed to the control element, wherein the platform member has a leg portion, and further comprising another potentiometer mounted on the leg portion, and means coupling the shaft to the another potentiometer for controlling the another potentiometer when the shaft is manually moved along its axis.

16. The joystick of claim 1, further comprising an electrical control element mounted on the platform member, the electrical control element having a shaft which serves as the manually operable means, and wherein the platform member has a leg portion which slidably engages the second yoke element to provide the coupling means.

17. The joystick of claim 16, wherein the first yoke element comprises a tubular sleeve and wherein the first means comprises a disc affixed to the shaft of the first potentiometer, one end of the sleeve being connected to the disc.

18. The joystick of claim 17, wherein the sleeve has a top portion with a slot through which the shaft extends and a bottom portion with an aperture through which the leg portion extends, and wherein the means for mounting the platform member pivotably mounts a portion of the platform member inside the tube.

19. The joystick of claim 18, further comprising a cover member slidably disposed inside the sleeve, the shaft extending through the cover member, and means for biassing the cover member away from the platform member.

20. A joystick, comprising:

a chassis;

a first potentiometer mounted on the chassis;

a first yoke element mounted on the chassis for pivoting movement about a first axis;

first means for coupling the first potentiometer to the first yoke element;

a second potentiometer mounted on the chassis;

a second yoke element mounted on the chassis for pivoting movement that is orthogonal to the first axis;

second means for coupling the second potentiometer to the second yoke element;

a platform member; and an electrical control member mounted on the platform member, the electrical control member having a manually actuable shaft, wherein one of the platform member and the shaft slidably engage the second yoke element to pivot the second yoke element about the second axis when the platform member pivots about the third axis.

* * * * *